US008474612B2

(12) United States Patent
Bertuzzi et al.

(10) Patent No.: US 8,474,612 B2
(45) Date of Patent: Jul. 2, 2013

(54) RIGID, HINGED-LID WITH GRIPPABLE TAB PACKAGE AND RELATIVE PACKING METHOD

(75) Inventors: Ivanoe Bertuzzi, Casalecchio di Reno (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 51 days.

(21) Appl. No.: 13/048,116

(22) Filed: Mar. 15, 2011

(65) Prior Publication Data

US 2012/0006823 A1 Jan. 12, 2012

(30) Foreign Application Priority Data

Mar. 15, 2010 (IT) ..... BO2010A0157

(51) Int. Cl.
*B65D 85/10* (2006.01)

(52) U.S. Cl.
USPC ..... 206/264; 206/268

(58) Field of Classification Search
USPC ..... 206/264–268, 273
See application file for complete search history.

(56) References Cited

U.S. PATENT DOCUMENTS

| | | | | |
|---|---|---|---|---|
| 5,715,936 | A * | 2/1998 | Focke et al. | 206/268 |
| 6,164,444 | A * | 12/2000 | Bray et al. | 206/268 |
| 6,478,149 | B1 * | 11/2002 | Parker | 206/264 |
| 6,505,735 | B1 * | 1/2003 | Parker | 206/268 |
| 8,091,703 | B2 * | 1/2012 | Marchetti et al. | 206/268 |
| 2010/0230303 | A1 * | 9/2010 | Buse et al. | 206/268 |

FOREIGN PATENT DOCUMENTS

| | | | |
|---|---|---|---|
| DE | 10 2007 031208 | A1 | 1/2009 |
| WO | WO-98/22367 | A1 | 5/1998 |
| WO | WO-99/28212 | A1 | 6/1999 |
| WO | WO-02/079051 | A1 | 10/2002 |
| WO | WO-2010/066543 | A1 | 6/2010 |

OTHER PUBLICATIONS

Search report from corresponding European Patent Office application No. EP 11158365, dated Jun. 30, 2011.

Search report from parent Italian application No. IT BO20100157, dated Nov. 22, 2010.

* cited by examiner

*Primary Examiner* — Bryon Gehman

(74) *Attorney, Agent, or Firm* — Marshall, Gerstein & Borun LLP

(57) ABSTRACT

A rigid package having a group of articles; an inner package enclosing the group of articles and having an extraction opening; a reclosable sealing panel, which closes the extraction opening of the inner package, and has an inner surface gummed with non-dry, re-stick adhesive, and a grip tab with no re-stick adhesive; and a rigid outer container, which houses the inner package, and has an open end, and a lid hinged to rotate between an open position and a closed position opening and closing the open end respectively; the grip tab being designed to project from the lid when the lid is in the closed position closing the open end.

12 Claims, 11 Drawing Sheets

RIGID, HINGED-LID WITH GRIPPABLE TAB PACKAGE AND RELATIVE PACKING METHOD

CROSS-REFERENCE TO RELATED APPLICATIONS

This application claims the benefit of Italian Patent Application No. BO2010A 000157, filed Mar. 15, 2010.

TECHNICAL FIELD

The present invention relates to a rigid, hinged-lid package and relative packing method and machine.

In the following description, reference is made, for the sake of simplicity and purely by way of a non-limiting example, to a rigid, him-red-lid packet of cigarettes.

BACKGROUND ART

A rigid, hinged-lid packet of cigarettes normally comprises an inner package enclosing a group of cigarettes; and a rigid outer container housing the inner package and having the hinged lid.

To preserve the organoleptic characteristics of the tobacco, a sealed inner package has recently been proposed, which is formed by folding and heat-sealing a sheet of airtight packing material. To extract the cigarettes, the inner package has a cigarette extraction opening closed by a reclosable sealing panel (i.e. an open/close panel coated with non-dry, re-stick adhesive) fixed directly to the inner package. The sealing panel normally has a grip tab, with no re-stick adhesive, by which to grip and lift it easily. In other words, to lift the sealing panel, the user simply grips the grip tab, which, unlike the rest of the sealing panel, is in no way fixed to the inner package underneath.

Patent Application WO02079051A1 describes a rigid packet of cigarettes with a sealed inner package of the above type.

DESCRIPTION OF THE INVENTION

It is an object of the present invention to provide a rigid, hinged-lid package that is easier to use and, at the same time, cheap and easy to produce.

Another object of the present invention is to provide a packing method and machine by which to produce such a rigid, hinged-lid package.

According to the present invention, there are provided a rigid, hinged-lid package and relative packing method and machine, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 2:
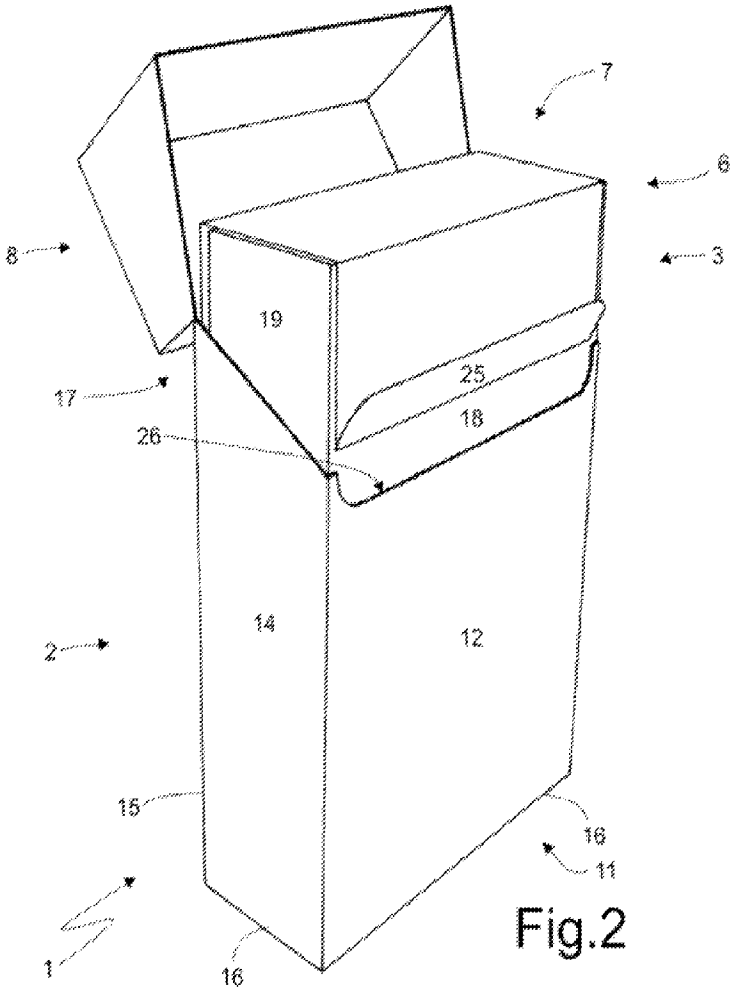
FIGS. 2-6 show front views in perspective of unsealing and closure of the FIG. 1 packet of cigarettes.
Figure 1:
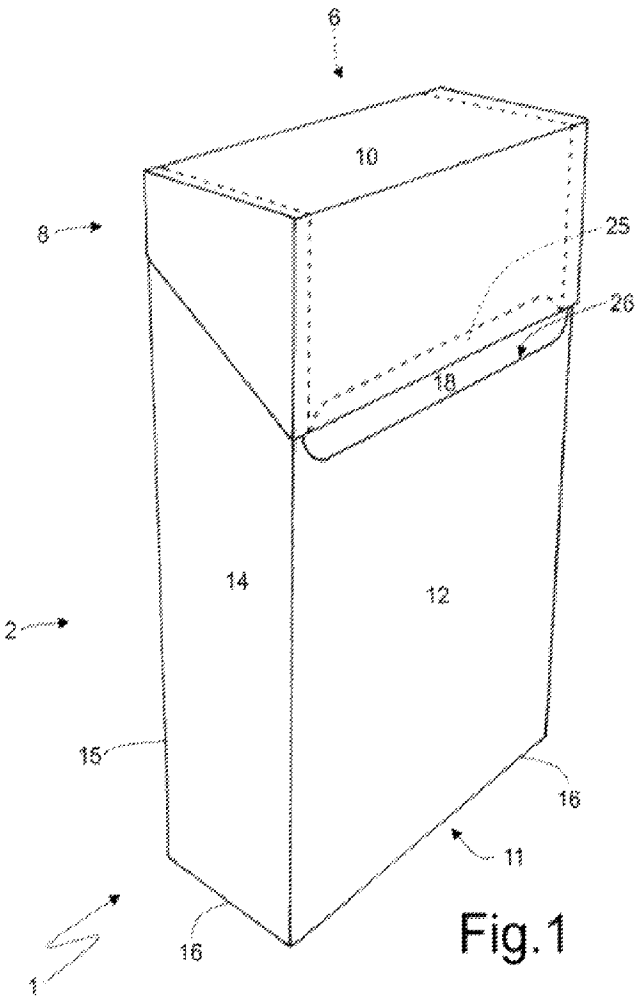
FIG. 1 shows a front view in perspective of a sealed (i.e. unopened) packet of cigarettes in accordance with the present invention in a closed configuration.

Number 1 in FIGS. 1-8 indicates as a whole a rigid packet of cigarettes comprising a cup-shaped rigid cardboard outer container 2; and a sealed inner package 3 (shown partly in FIGS. 2-6) housed inside container 2. Sealed inner package 3 encloses a parallelepiped-shaped group 4 of cigarettes (FIG. 4), and has, at the top and front, a central cigarette extraction opening 5 (FIG. 4) closed by a reclosable (i.e. open-close) sealing panel 6 and extending over respective portions of a front wall and top wall of sealed inner package 3. Sealing panel 6 is movable between a closed configuration (FIGS. 2, 3, 5, 6) closing extraction opening 5, and an open configuration (FIG. 4) opening extraction opening 5, is normally in the closed configuration closing extraction opening 5, and is lifted temporarily from the closed to the open configuration to permit withdrawal of the cigarettes through extraction opening 5.

Outer container 2 has an open top end 7; and a cup-shaped lid 8 hinged to container 2 along a hinge 9 (FIG. 8) to rotate, with respect to container 2, between an open position (FIGS. 2-6) and a closed position (FIGS. 1, 7, 8) opening and closing open top end 7 respectively.

When lid 8 is in the closed position, outer container 2 is in the Colin of a rectangular parallelepiped comprising a top wall 10 and bottom wall 11 opposite and parallel to each other; two opposite parallel major lateral walls 12, 13; and two opposite parallel minor lateral walls 14. More specifically, one major lateral wall 12 defines a front wall 12 of outer container 2, and the other major lateral wall 13 defines a rear wall 13 of outer container 2. Four longitudinal edges 15 are defined between lateral walls 14 and front and rear walls 12, 13; and eight transverse edges 16 are defined between top and bottom walls 10, 11 and front, rear, and lateral walls 12, 13, 14.

In the FIG. 1-8 embodiment, edges 15 and 16 are all square, but in alternative embodiments not shown, some of edges 15 and 16 may be bevelled or rounded.

Packet 1 also comprises a rigid (i.e. rigid-cardboard) collar 17, which is folded about inner package 3 to at least partly cover a top portion of inner package 3, and is fixed (normally glued) to inner package 3. In one embodiment, inner package 3 and/or collar 17 (which are glued integrally and non-detachably to each other) are/is also glued to outer container 2. Collar 17 (together with inner package 3 covered partly by it) projects partly outwards of open top end 7, and engages a corresponding inner surface of lid 8 when lid 8 is closed.

Figure 4:
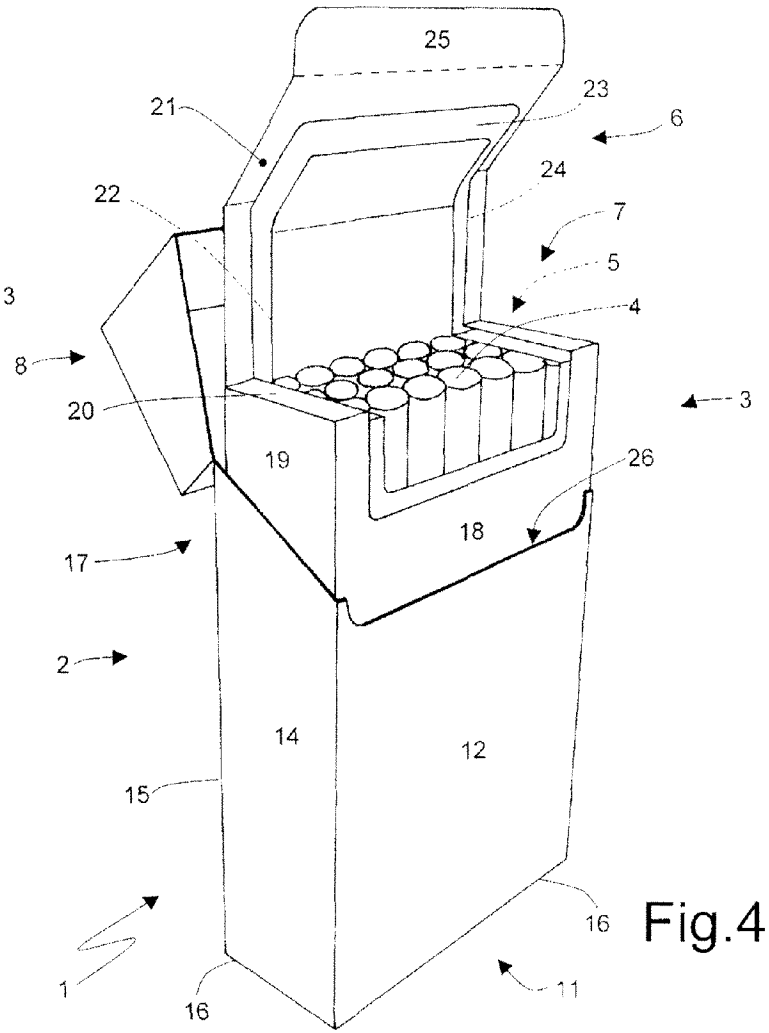
Figure 3:
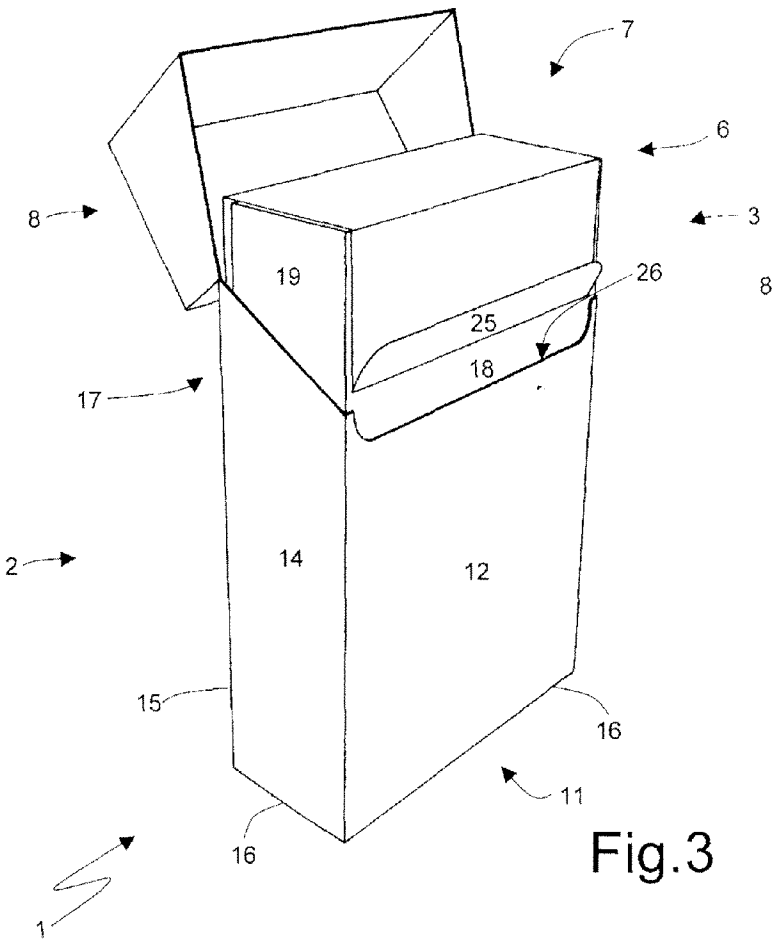

As shown more clearly in FIG. 4, collar 17 comprises a front wall 18, which on the inside contacts a front wall of inner package 3, and on the outside contacts front wall 12 of outer container 2; two lateral walls 19 located on opposite sides of front wall 18, and which on the inside contact lateral walls of inner package 3, and on the outside contact minor lateral walls 14 of outer container 2; atop wall 20, which on the inside contacts atop wall of inner package 3, and on the outside contacts top wall 10 of outer container 2 when lid 8 is closed; and a rear wall (not shown), which on the inside contacts a rear wall of inner package 3, and on the outside contacts rear wall 13 of outer container 2 when lid 8 is closed.

Reclosable sealing panel 6 for closing extraction opening 5 of inner package 3 is located over collar 17, and has an inner surface 21 (FIG. 4), which is gummed with non-dry, re-stick adhesive, and adheres to collar 17 (or, rather, to the parts of walls 18 and 20 of collar 17 surrounding extraction opening 5) when reclosable sealing panel 6 is closed. In other words, when closed, reclosable sealing panel 6 adheres to the parts of walls 18 and 20 of collar 17 surrounding extraction opening 5, to close (seal) extraction opening 5, and can be lifted temporarily into the open configuration to open, and permit withdrawal of the cigarettes through, extraction opening 5. More specifically, reclosable sealing panel 6 is fixed permanently at the rear wall of inner package 3, and rotates, between the open and closed configurations to open and close extraction opening 5, about a hinge along a transverse edge between the top wall and rear wall of inner package 3 (i.e. between top wall 20 and the rear wall of collar 17, i.e. between top wall 10 and rear wall 13 of outer container 2).

As shown in FIG. 4, cigarette extraction opening 5 of inner package 3 is defined by a U-shaped incision 22 formed in a top portion of the front wall of inner package 3, and extending along the whole of the top wall of inner package 3 (without touching the rear wall of inner package 3, i.e. only extending as far as a transverse edge between the top wall and rear wall of inner package 3).

In a preferred embodiment, reclosable sealing panel 6 incorporates a detachable portion 23 (FIG. 4) of collar 17, which is separated from the rest of collar 17 by a U-shaped incision 24 enclosing incision 22 of extraction opening 5. Detachable portion 23 of collar 17 is glued on one side to sealing panel 6 (i.e. to inner surface 21 of sealing panel 6) by the non-dry, re-stick glue on sealing panel 6, and is glued on the other side to the part of inner package 3 bounded by incision 22 by further adhesive applied for the purpose (and which may be either non-dry, re-stick or permanent adhesive).

Reclosable sealing panel 6 is fixed permanently at the rear wall of inner package 3. Alternatively, collar 17 has no rear wall, and reclosable sealing panel 6 is fixed permanently directly to the rear wall of inner package 3; or collar 17 has a rear wall partly covering the rear wall of inner package 3, and reclosable sealing panel 6 is fixed permanently to the rear wall of collar 17.

Reclosable sealing panel 6 has a grip tab 25 with no re-stick adhesive on inner surface 21, and which is located close to, normally below, extraction opening 5 for easy grip and lift of sealing panel 6. In other words, sealing panel 6 can be raised by the user simply gripping grip tab 25, which, unlike the rest of sealing panel 6, is in no way fixed to collar 17 underneath.

Figure 6:
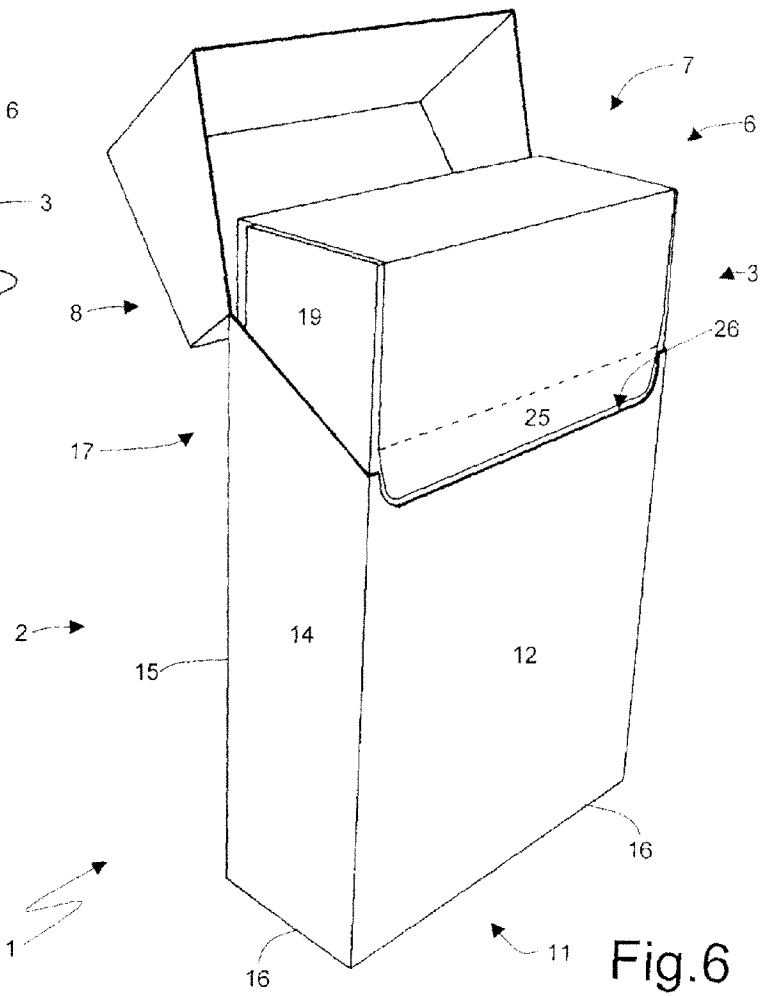
Figure 5:
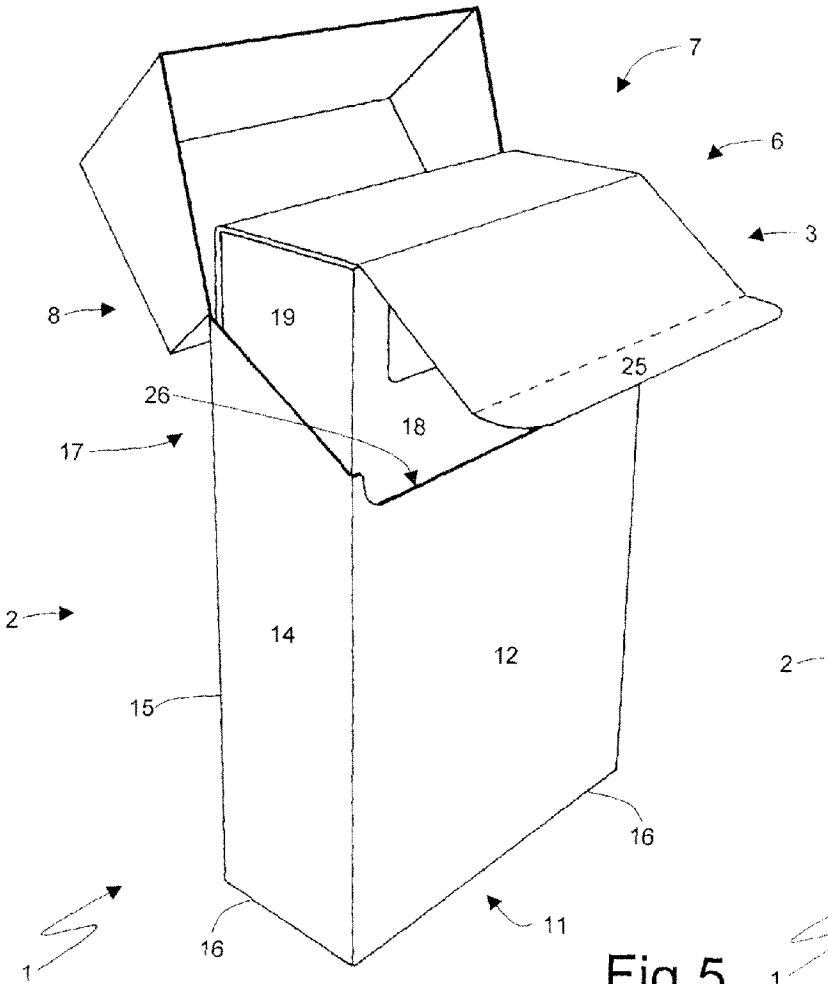
Figure 8:
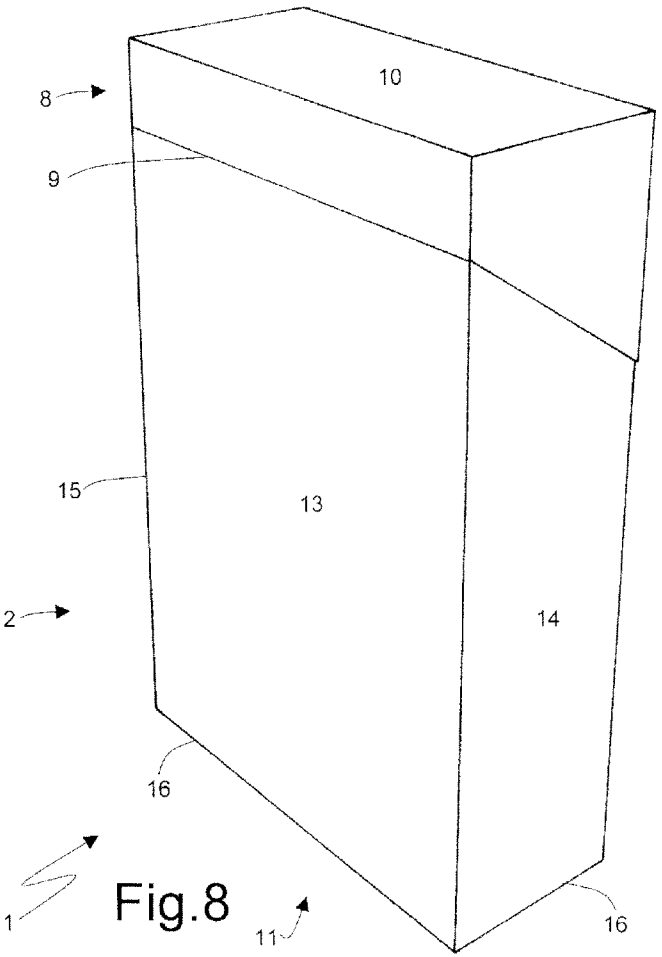
FIG. 8 shows a rear view in perspective of the FIG. 1 packet of cigarettes in a closed configuration.
Figure 7:
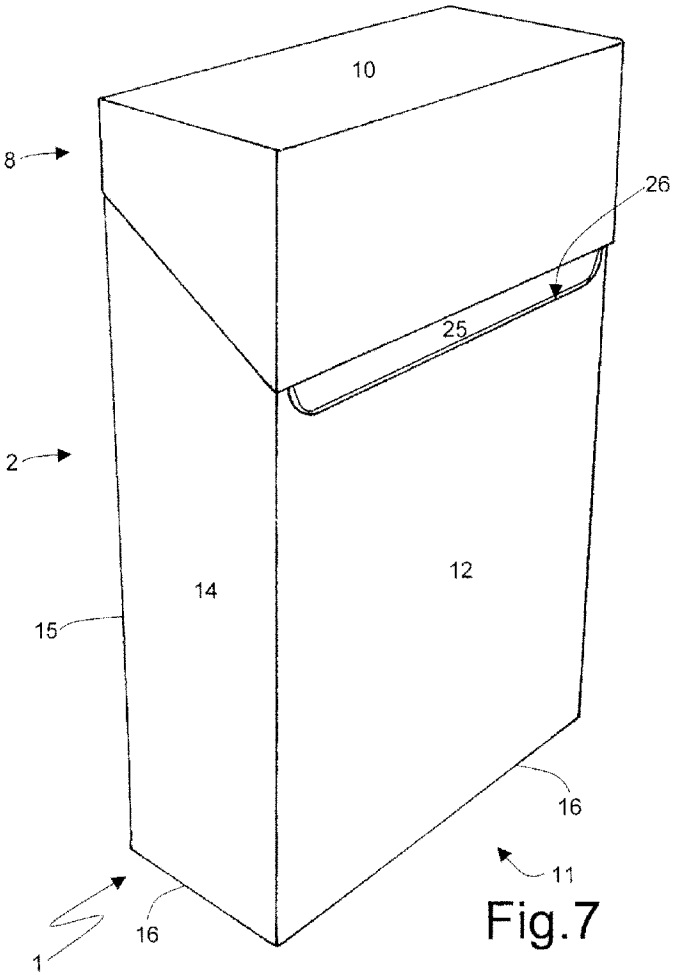
FIG. 7 shows a front view in perspective of the unsealed FIG. 1 packet of cigarettes in a closed configuration.

As shown in FIGS. 6 and 7, grip tab 25 is designed to project from lid 8 when lid 8 is in the closed position closing open end 7. In the preferred embodiment shown in FIGS. 1-7, grip tab 25 is initially in a closed configuration (FIG. 1), in which grip tab 25 is folded 180° onto an outer surface of sealing panel 6, so as not to project from lid 8 when lid 8 is in the closed position closing open end 7 (FIG. 1); is maintained in the closed configuration by lid 8 in the closed position closing open end 7; and assumes an open configuration (FIGS. 6 and 7), when lid 8 is first opened, in which grip tab 25 projects from lid 8 in the closed position closing open end 7 (as shown in FIG. 7). This embodiment clearly indicates externally whether packet 1 of cigarettes is still sealed—in which case, grip tab 25 is in the closed configuration, not projecting from lid 8 in the closed position, and therefore invisible when packet 1 is sealed—or whether packet 1 of cigarettes has been opened at least once—in which case, grip tab 25 projects from lid 8 in the closed position, and is therefore also visible when packet 1 is closed In a different embodiment, grip tab 25 is also initially positioned, i.e. from the outset, in the open configuration (FIGS. 6 and 7) projecting from lid 8 in the closed position closing open end 7 (as shown in FIG. 7).

In the FIG. 1-8 embodiment, front wall 12 of outer container 2 has a through opening 26 located along a bottom edge of lid 8 and for housing the part of grip tab 25 that projects from lid 8 in the closed position closing open end 7. Through opening 26 exposes part of front wall 18 of collar 17 underneath. In other words, front wall 18 of collar 17 is positioned contacting front wall 12 of outer container 2, and closes opening 26 in front wall 12 of outer container 2 from the inside.

In actual use, when grip tab 25 projects from lid 8 in the closed position, the user, to extract a cigarette from packet 1, can either push open lid 8 and then open sealing panel 6 by pulling up grip tab 25, or pull up grip tab 25 from the outset to open lid 8 and sealing panel 6 simultaneously. In other words, by pulling up grip tab 25 when lid 8 is in the closed position, lid 8 and sealing panel 6 can be opened simultaneously in one operation.

In an alternative embodiment, sealing panel 6 is glued to lid 8 (i.e. an outer surface of sealing panel 6 is glued to an inner surface of lid 8) so that sealing panel 6 and lid 8 open and close together.

Figure 9:
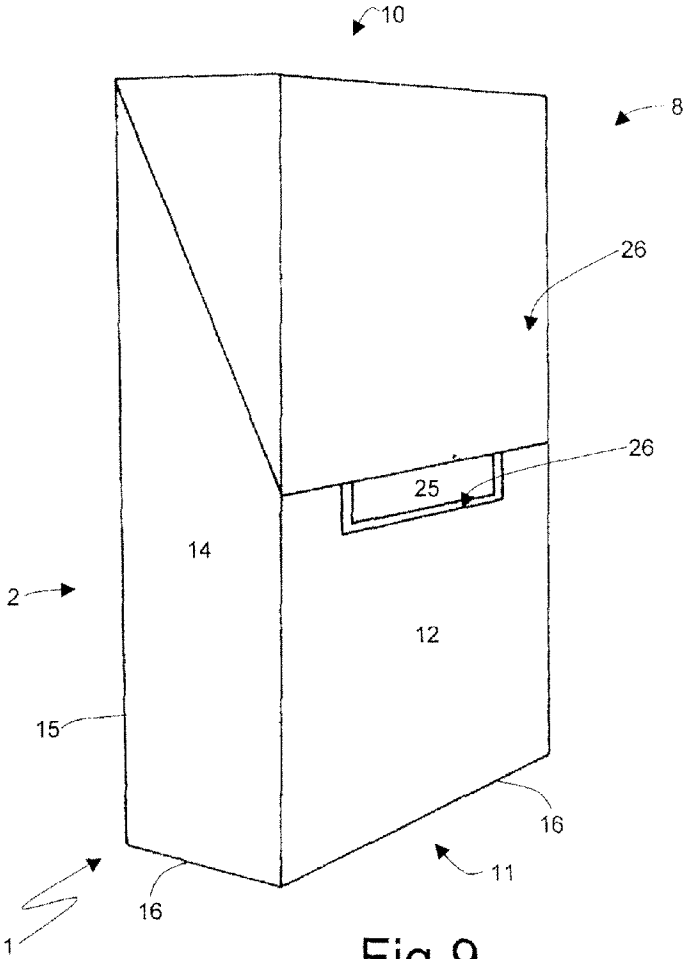
FIG. 9 shows a front view in perspective of an alternative embodiment of a packet of cigarettes in accordance with the present invention in a closed configuration.

The FIG. 9 embodiment of packet 1 of cigarettes differs from the one in FIGS. 1-8 as regards the shape and/or size o r lid 8, grip tab 25 of sealing panel 6, and through opening 26 in front wall 12 of outer container 2.

Figure 10:
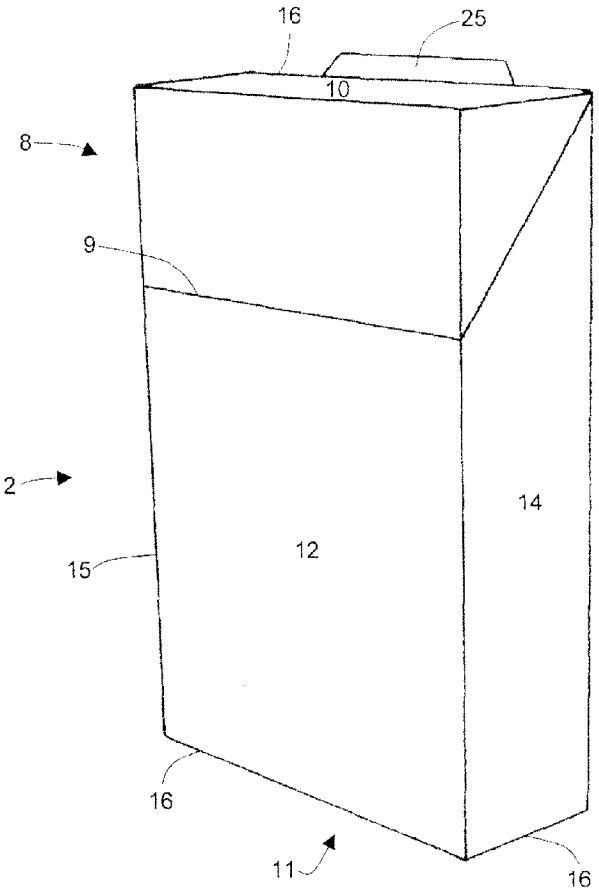
FIG. 10 shows a front view in perspective of an alternative embodiment of a packet of cigarettes in accordance with the present invention in a closed configuration.
Figure 12:
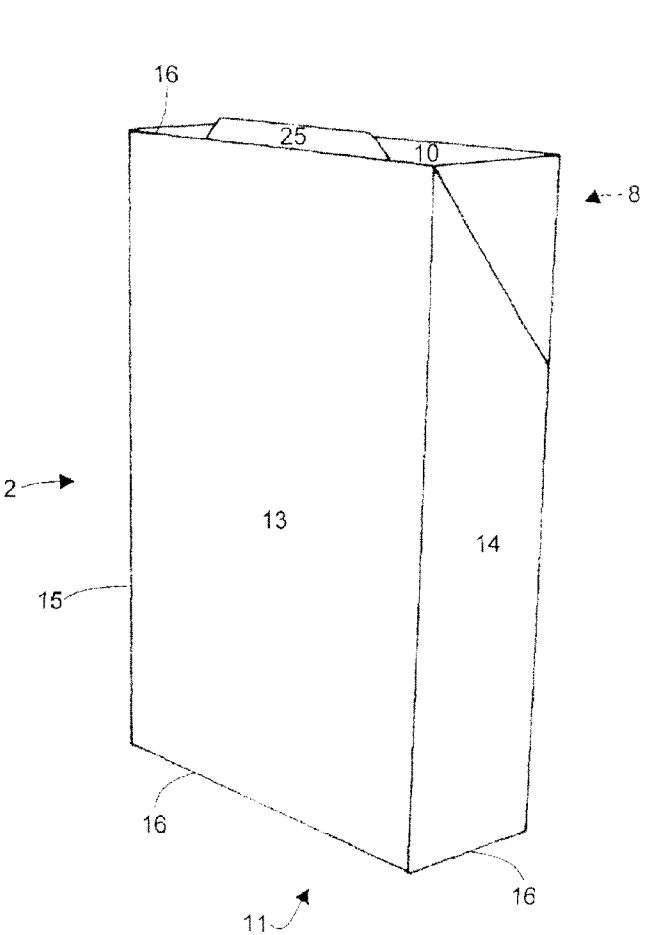
FIG. 12 shows a rear view in perspective of the FIG. 10 packet of cigarettes in a closed configuration.
Figure 11:
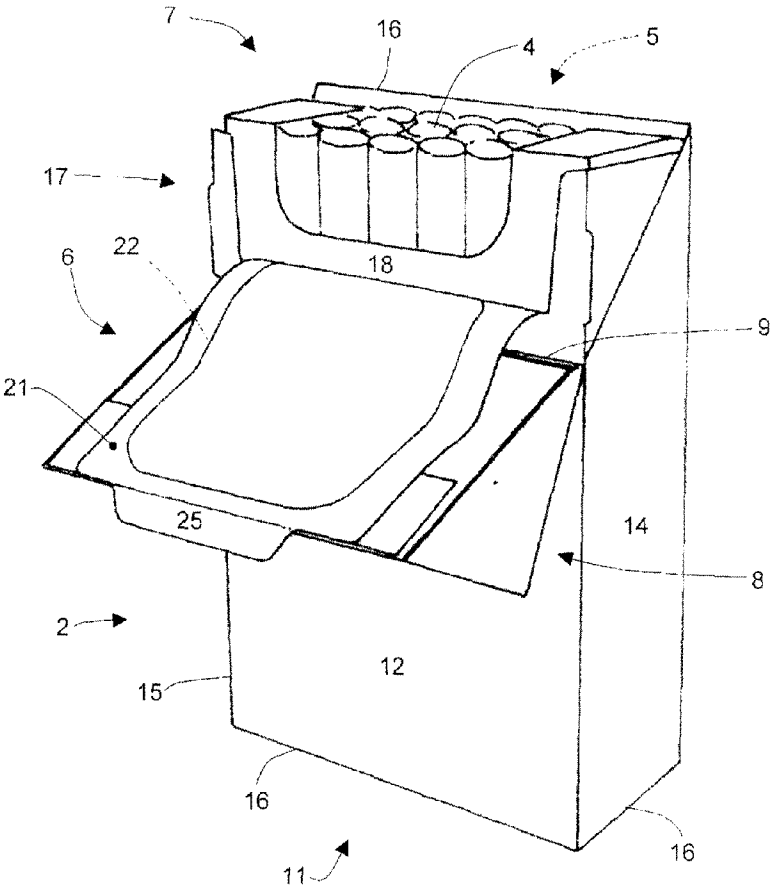
FIG. 11 shows a front view in perspective of the FIG. 10 packet of cigarettes in an open configuration.

In the FIG. 1-8 embodiment of packet 1 of cigarettes, hinge 9 of lid 8 is formed on rear wall 13 of outer container 2. and lid 8 covers the whole of top wall 10 and part of front wall 12, rear wall 13, and minor lateral walls 14 of outer container 2, as in most currently marketed rigid packets of cigarettes, so grip tab 25 can project from lid 8. in the closed position closing open end 7, on front wall 12 of outer container 2. In the FIG. 10-12 embodiment of packet 1 of cigarettes, on the other hand, hinge 9 of lid 8 is formed on front wall 12 of outer container 2, and lid 8 covers the whole of top wall 10 and part of front wall 12 and minor lateral walls 14 of outer container 2 (i.e. covers no part of rear wall 13), so grip tab 25 can project from lid 8, in the closed position closing open end 7, at the transverse edge 16 defined between top wall 10 and rear wall 13 of outer container 2.

Figure 13:
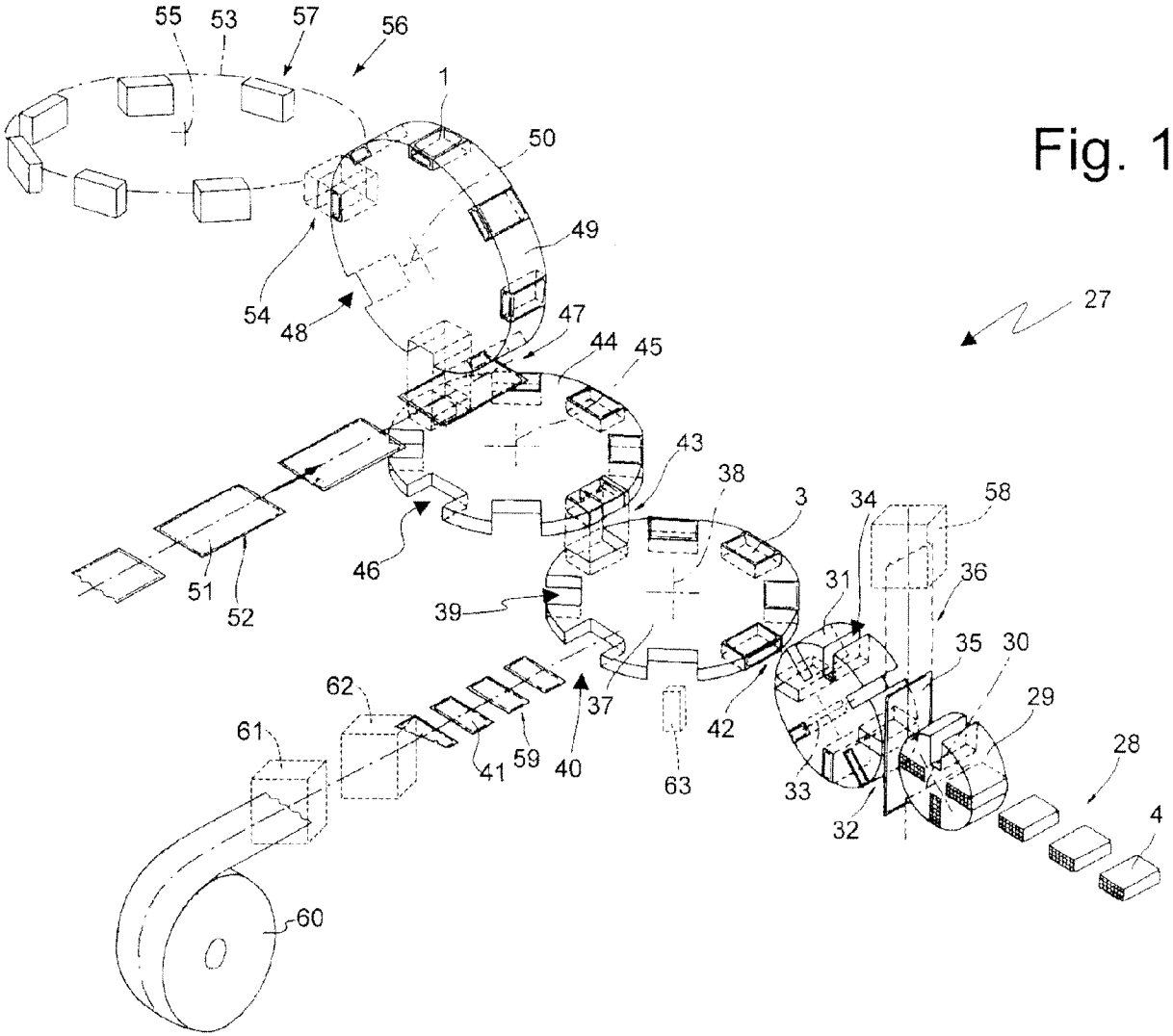
FIG. 13 shows a schematic view in perspective, with parts removed for clarity, of part of a packing machine for producing the FIG. 1 packet of cigarettes.

FIG. 13 shows an overall schematic of a cigarette packing machine 27, an X2 or X3 type produced by G. D. Societa per Azioni, for producing the FIG. 1-8 packet 1 of cigarettes described above.

Packing machine 27 comprises a known line 28 (only shown partly) for forming groups 4 of cigarettes; and a first transfer wheel 29, which rotates in steps about a respective horizontal axis of rotation 30 to successively receive groups 4 of cigarettes, and to transfer groups 4 of cigarettes to a second packing wheel 31 at a transfer station 32. Second packing wheel 31 is mounted to rotate in steps about a respective axis of rotation 33 parallel to axis of rotation 30, comprises a number of peripheral pockets 34, each for receiving a group 4 of cigarettes together with a respective flexible sheet 35 of foil packing material fed to transfer station 32 by a feed line 36, and folds each sheet 35 of packing material about respective group 4 of cigarettes to form an inner package 3.

Packing machine 27 also comprises a third packing wheel 37, which rotates in steps about a respective vertical axis of rotation 38 crosswise to axis of rotation 30. Third packing wheel 37 comprises a number of peripheral pockets 39, which are rotated in steps about axis of rotation 38 and fed successively through a feed station 40 for supplying creased cardboard blanks 41 complete with scaling panels 6 and from which to form collars 17. At feed station 40, each pocket 39 receives a blank 41, which is folded into a U inside pocket 39 by folding panels 23' ninety deuces with respect to panel 19' about the two longitudinal fold lines 35. Third packing wheel 37 also rotates through a transfer station 42 for transferring inner packages 3, and where an inner package 3 is inserted into the U-folded blank 41 inside each pocket 39. Downstream from transfer station 42, folding devices (not shown) finish folding each blank 41 about inner package 3 to form respective collar 17 complete with sealing panel 6. Finally, third packing wheel 37 rotates through a transfer station 43, where each inner package 3, fitted with a collar 17 complete with sealing panel 6, is expelled from pocket 39 and transferred to a fourth packing wheel 44.

Fourth packing wheel 44 rotates in steps about a respective axis of rotation 45 parallel to axis of rotation 38, is structurally identical to third packing wheel 37, and comprises a number of peripheral pockets 46. In pockets 39 on third packing wheel 37, and pockets 46 on fourth packing wheel 44, each rectangular-parallelepiped-shaped inner package 3 is positioned flat, i.e. with a minor lateral surface facing outwards, and with its longitudinal axis (the axis parallel to the cigarette axes) crosswise to axes of rotation 38, 45, and tangent to the periphery of packing wheels 37, 44. Fourth packing wheel 44 and third packing wheel 37 overlap at transfer station 43, and inner packages 3 are transferred from third packing wheel 37 to fourth packing wheel 44 in a vertical movement parallel to axes of rotation 38, 45.

At a transfer station 47, each inner package 3, fitted with a collar 17 complete with sealing panel 6, is transferred from a pocket 46 on fourth packing wheel 44 to a pocket 48 on a fifth packing wheel 49. Fifth packing wheel 49 is mounted to rotate in steps about a respective horizontal axis of rotation 50 parallel to axis of rotation 30, receives each inner package 3 and respective collar 17, complete with sealing panel 6, together with a respective rigid blank 51 fed to transfer station 47 by a feed line 52, and folds each blank 51 about relative inner package 3 to form a packet 1 of cigarettes, in which inner package 3 is housed inside an outer container 2 formed by folding blank 51.

Packets 1 are transferred successively from fifth packing wheel 49 to a sixth transfer wheel 53 at a transfer station 54. More specifically, each packet 1 arriving at transfer station 54 is positioned on edge on the periphery of fifth packing wheel 49, i.e. with a major lateral surface of packet 1 facing outwards, and with the longitudinal axis (the axis parallel to the cigarettes) of packet 1 parallel to axis of rotation 50 of fifth packing wheel 49.

Sixth transfer wheel 53 rotates in steps about a respective vertical axis of rotation 55 crosswise to axis of rotation 50 of fifth packing wheel 49, receives packets 1 successively from fifth packing wheel 49 at transfer station 54, and transfers packets 1 to a drying area 56 (shown schematically) at a transfer station 57. Drying area 56 forms the output of packing machine 27, and feeds packets 1 of cigarettes to a follow-up cellophaning machine (not shown which applies an overwrap of transparent plastic material about each packet 1 of cigarettes.

Feed line 36 supplying flexible sheets 35 of foil packing material has a cutting device 58, which makes U-shaped incision 22, defining cigarette extraction opening 5, in each sheet 35.

Blanks 41 from which collars 17 are made are fed to feed station 40 on a feed line 59, and are obtained in known manner by transversely cutting a continuous strip of cardboard unwound off a reel 60. Feed line 59 comprises a cutting device 61 for forming in each blank 41 U-shaped incision 24 defining detachable portion 23 of collar 17, which adheres to reclosable sealing panel 6; and an application device 62 for applying reclosable sealing panel 6 to each blank 41. Reclosable sealing panel 6 is preferably obtained from a reel, with non-dry, re-stick adhesive already applied to inner surface 21 (i.e. is self-adhesive).

A gumming device 63 applies adhesive (non-dry, re-stick or permanent adhesive) to the side of detachable portion 23 of each collar 17 facing inner package 3, so that detachable portion 23 adheres to the part of inner package 3 bounded by incision 22. In FIG. 13, gumming device 63 is located at packing wheel 37, but may alternatively be located along feed line 59. Gumming device 63 applies adhesive to at least detachable portion 23 of each collar 17, but may also apply adhesive to parts of collar 17 other than detachable portion 23, so as to glue collar 17 to inner package 3. In this way, even when half-empty, inner package 3 is supported by rigid collar 17 and so prevented from collapsing and making it difficult to withdraw the cigarettes through extraction opening 5.

Figure 14:
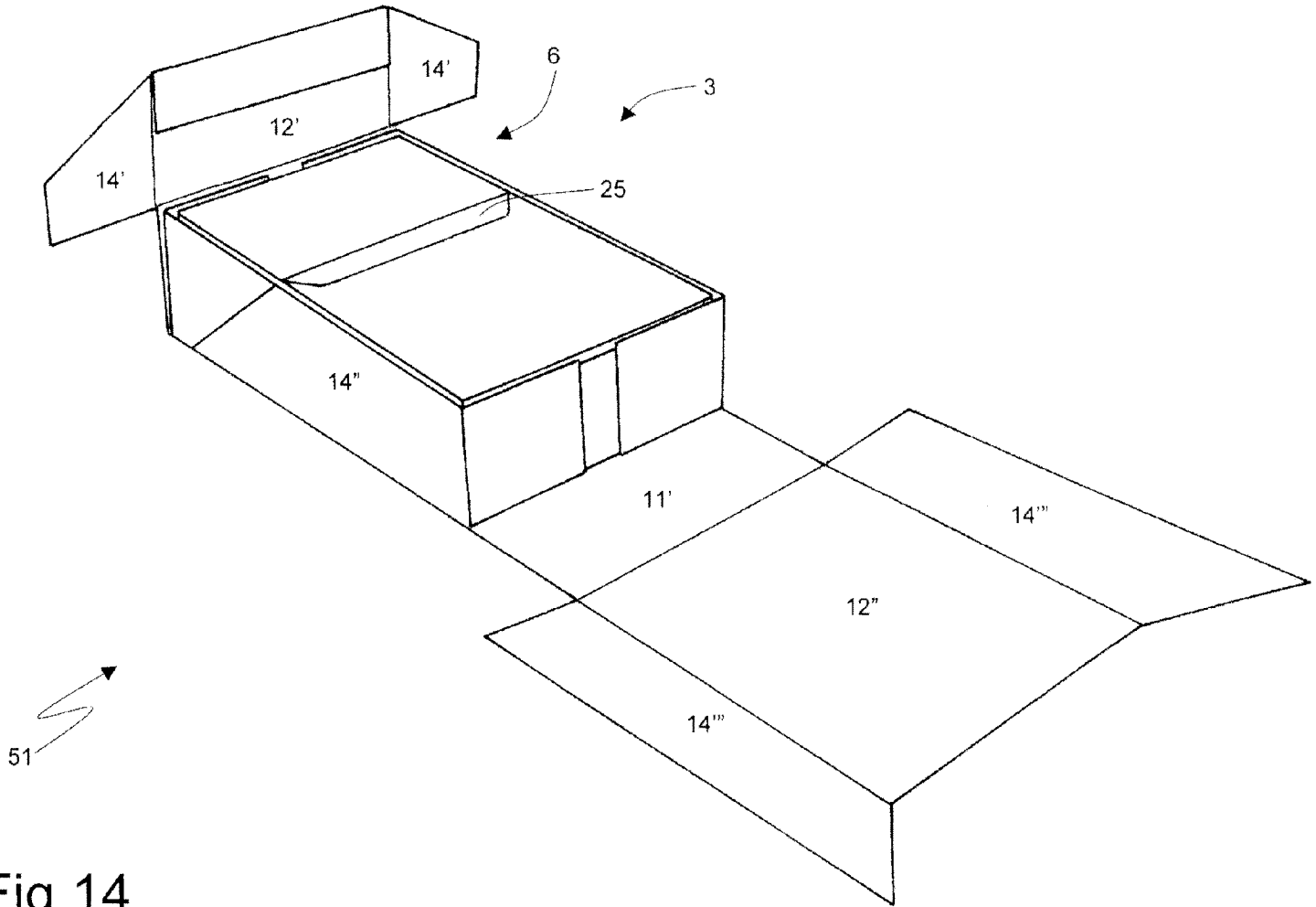
FIGS. 14-17 show views in perspective of a folding sequence performed on a packing wheel of the FIG. 13 packing machine.
Figure 15:
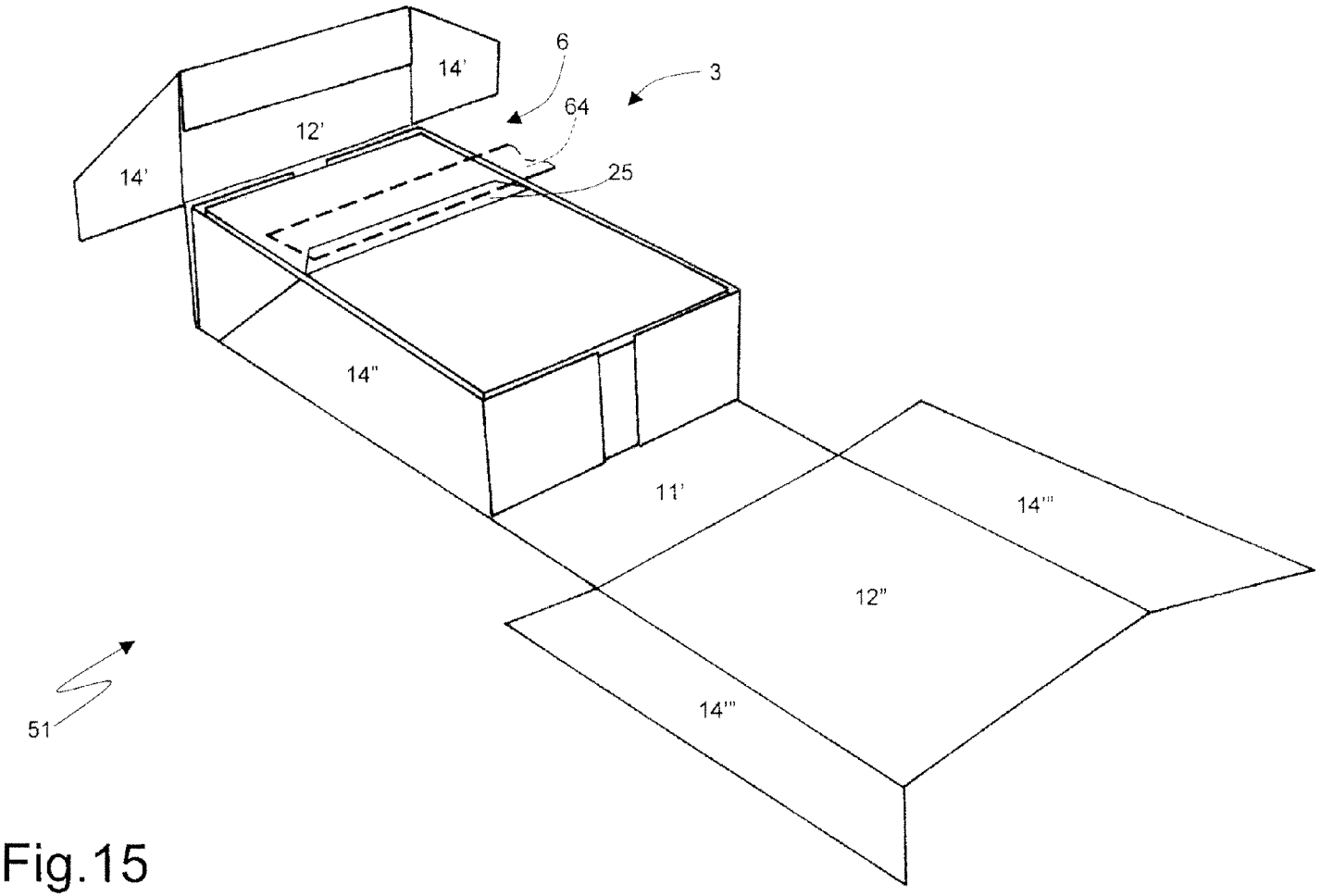

FIGS. 14-17 show views in perspective of the sequence of operations performed on fifth packing wheel 49 of packing machine 27 to fold each blank 51 about respective inner package 3 to form a packet 1 of cigarettes, in which inner package 3 is housed inside an outer container 2 formed by folding blank 51. More specifically, in a pocket 48 on fifth packing wheel 49, blank 51 is folded partly about inner package 3 as shown in FIG. 14, and the next step in the sequence calls for folding panel 12' forming the part of front wall 12 forming part of lid 8, and tabs 14' forming the part of lateral walls 14 forming part of lid 8. In this condition, and as shown in FIG. 15, before panel 12' and tabs 14' are folded, a folding device 64 folds grip tab 25 180° with respect to the rest of sealing panel 6 into the closed configuration on an outer surface of sealing panel 6.

Figure 16:
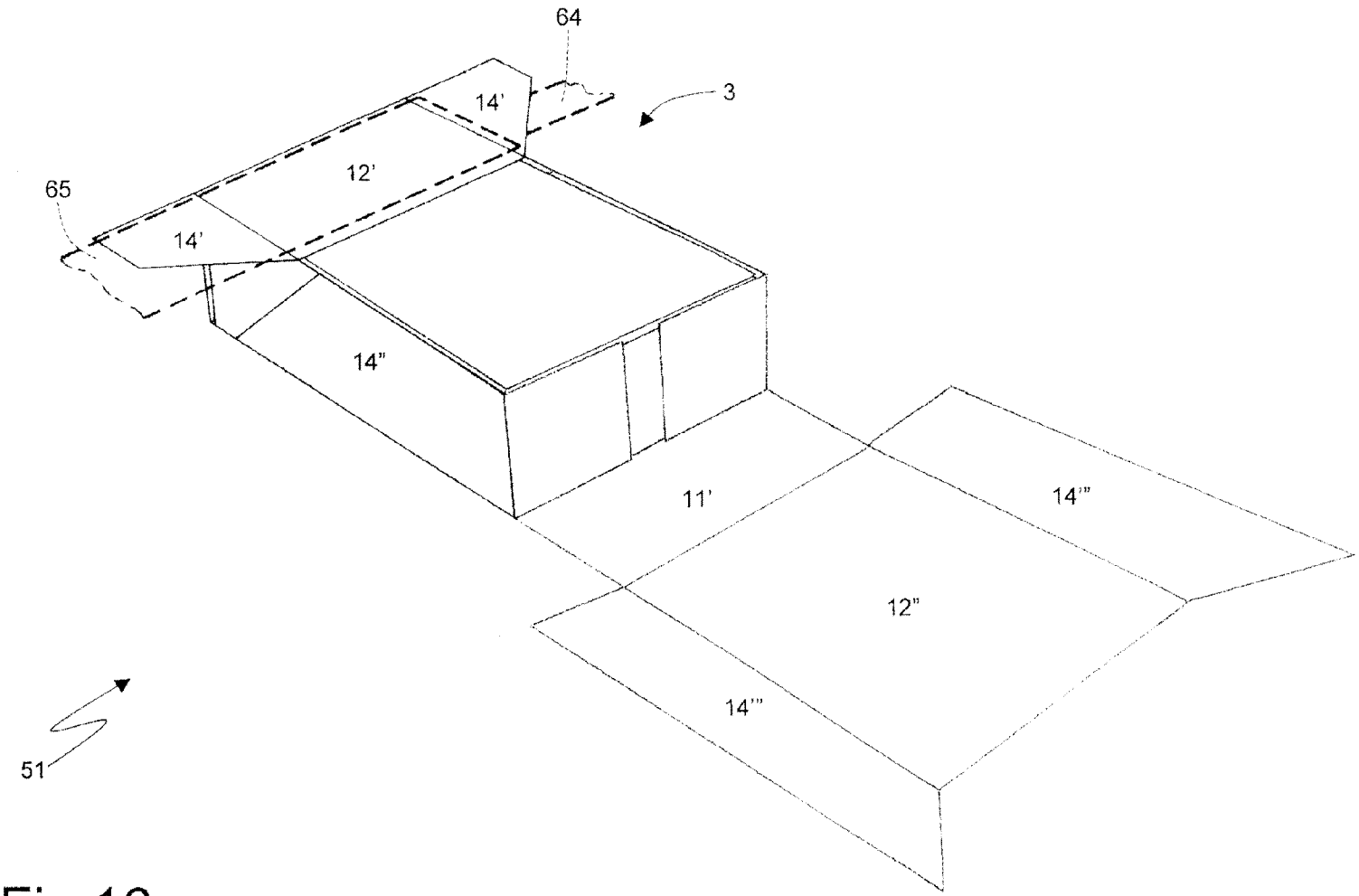

As shown in FIG. 16, a folding device 65 then folds panel 12' over grip tab 25 in the closed configuration, so grip tab 25 is kept in the closed configuration by lid 8 in the closed position closing open end 7.

Figure 17:
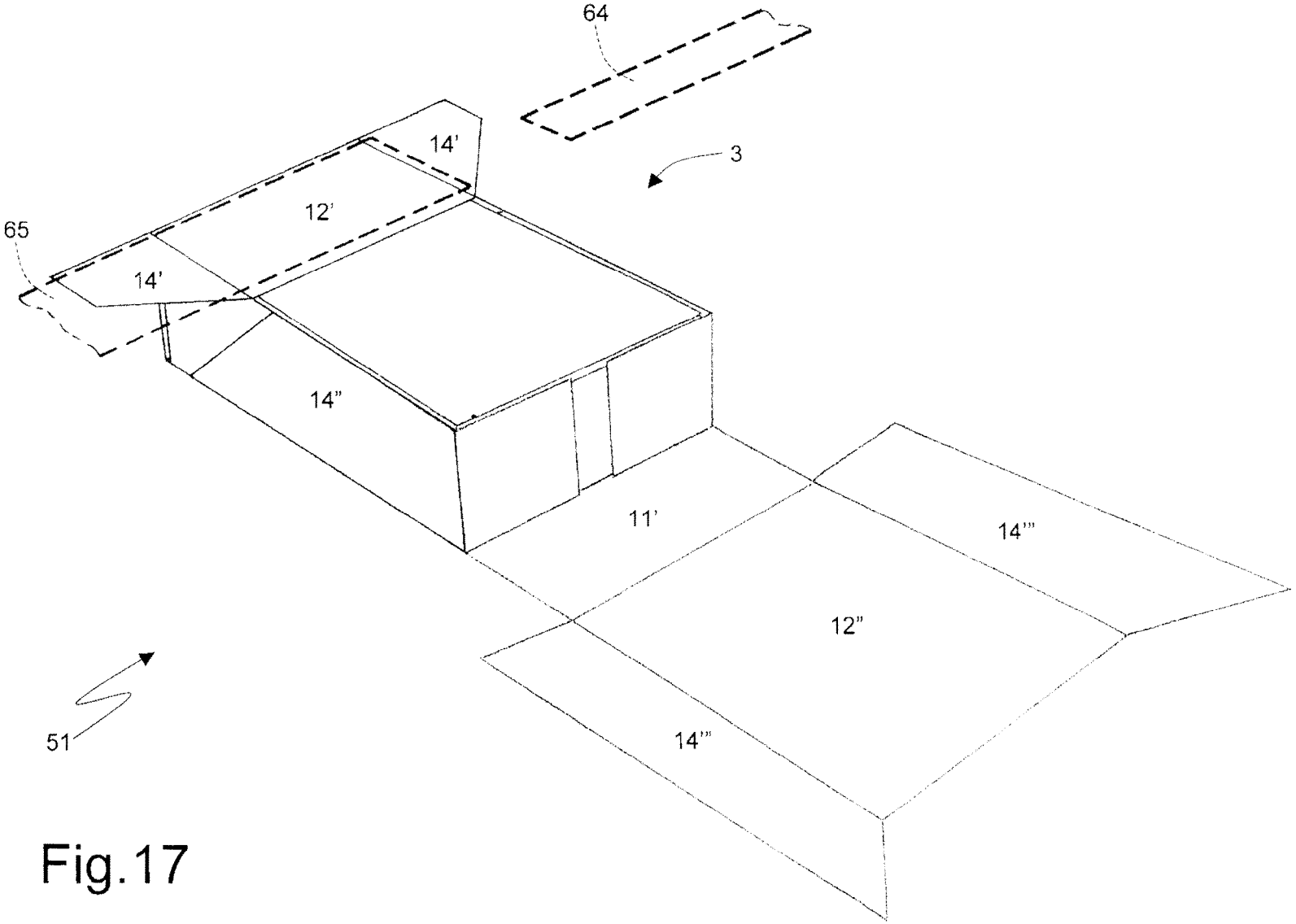

In a preferred embodiment shown in FIG. 16, folding device 64 is thin, and is held in position over grip tab 25 as folding device 65 folds panel 12' over grip tab 25 and folding device 64. As shown in FIG. 17, once panel 12' is folded by folding device 65 over grip tab 25 and folding device 64, folding device 64 is withdrawn laterally to fully release inner package 3 and blank 51, so tabs 14' can then be folded to complete the formation of lid 8. In other words, folding device 64 holds grip tab 25 in the closed configuration as panel 12' is folded over grip tab 25, to prevent springback of grip tab 25 before it is clamped in the closed configuration by panel 12'.

Packet 1 of cigarettes described above has numerous advantages.

In particular, it allows lid 8 and sealing panel 6 to be opened simultaneously in one operation by simply pulling up grip tab 25 projecting from lid 8 in the closed position closing open top end 7 of outer container 2, thus making packet 1 of cigarettes much easier to use as compared with similar known packets of cigarettes.

Secondly, packet 1 of cigarettes described indicates clearly whether lid 8 is sealed (in which case, grip tab 25 does not project from lid 8 in the closed position closing open top end 7 of outer container 2) or has been opened (in which case, grip tab 25 projects from lid 8 in the closed position closing open top end 7 of outer container 2).

Finally, packet 1 of cigarettes described can easily be produced on a standard packing machine (which only requires a few minor alterations), as opposed to a special, high-cost packing machine (i.e. specially designed for packets of cigarettes of this type).

In view of its many advantages, the package described may also be used for articles other than cigarettes, e.g. food products (such as sweets, chocolates or other confectionary).

The invention claimed is:

1. A rigid package comprising:

a group (4) of articles;

an inner package (3) enclosing the group (4) of articles and having an extraction opening (5);

a reclosable sealing panel (6), which closes the extraction opening (5) of the inner package (3), and has an inner surface (21) gummed with non-dry, re-stick adhesive, and a grip tab (25) with no re-stick adhesive; and a rigid outer container (2), which houses the inner package (3), and has an open end (7), and a lid (8) hinged to rotate between an open position and a closed position opening and closing the open end (7) respectively;

the package (1) being characterized in that:

a) the grip tab (25) has a first closed configuration, in which the grip tab (25) is folded 180° onto an outer surface of the sealing panel (6), so as not to project from the lid (8) when the lid (8) is in the closed position closing the open end (7) with the grip tab (25) maintained in the closed configuration by the lid (8) in the closed position closing the open end (7); and b) the grip tab (25) has a second, subsequent open configuration in which the grip tab (25) projects away from the lid (8) so as to be grippable in the closed position of the lid (8) closing the open end (7).

2. A package as claimed in claim 1, wherein:

the outer container (2) is rectangular parallelepiped-shaped, and comprises: a top wall (10) and a bottom wall (11) opposite and parallel to each other; a front wall (12) and a rear wall (13) opposite and parallel to each other; and two opposite, parallel minor lateral walls (14);

a hinge (9) of the lid (8) is located on the rear wall (13) of the outer container (2); and the front wall (12) of the outer container (2) has a through opening (26) located along a bottom edge of the lid (8) and for housing the part of the grip tab (25) that projects away from the lid (8) so as to be grippable in the closed position of the lid (8) closing the open end (7).

3. A package as claimed in claim 2, and comprising a rigid collar (17) that projects partly from the open end (7) of the outer container (2), and has a front wall (18) that contacts the front wall (12) of the outer container (2) and internally closes the opening (26) in the front wall (12) of the outer container (2).

4. A package as claimed in claim 1, wherein:

the outer container (2) is rectangular parallelepiped-shaped, and comprises: a top wall (10) and a bottom wall (11) opposite and parallel to each other; a front wall (12) and a rear wall (13) opposite and parallel to each other; and two opposite, parallel minor lateral walls (14);

a hinge (9) of the lid (8) is located on the front wall (12) of the outer container (2); and the grip tab (25) can project away from the lid (8) so as to be grippable, in the closed position closing the open end (7), along a transverse edge (16) defined between the top wall (10) and the rear wall (13) of the outer container (2).

5. A package as claimed in claim 4, wherein the lid (8) covers the whole of the top wall (10) of the outer container (2), and part of the front wall (12) and part of the minor lateral walls (14) of the outer container (2).

6. A package as claimed in claim 1, wherein an outer surface of the sealing panel (6) is glued to an inner surface of the lid (8).

7. A package as claimed in claim 1, and comprising a rigid collar (17) that projects partly from the open end (7) of the outer container (2), is folded about the inner package (3) to at least partly cover a top portion of the inner package (3), and is fixed to the inner package (3); the reclosable sealing panel (6) is located over the collar (17), and has an inner surface (21) gummed with non-dry, re-stick adhesive, and which adheres to the collar (17) when the reclosable sealing panel (6) is in a closed position.

8. A package as claimed in claim 7, wherein:

the reclosable sealing panel (6) is fixed permanently at a rear wall of the inner package (3); the collar (17) has no rear wall, and the reclosable sealing panel (6) is fixed permanently and directly to the rear wall of the inner package (3).

9. A package as claimed in claim 7, wherein:

the reclosable sealing panel (6) is fixed permanently at a rear wall of the inner package (3); the collar (17) comprises a rear wall that partly covers the rear wall of the inner package (3), and the reclosable sealing panel (6) is fixed permanently to the rear wall of the collar (17).

10. A rigid package comprising:

a group (4) of articles;

an inner package (3) enclosing the group (4) of articles and having an extraction opening (5);

a reclosable sealing panel (6), which closes the extraction opening (5) of the inner package (3), and has an inner surface (21) gummed with non-dry, re-stick adhesive, and a grip tab (25) with no re-stick adhesive; and a rigid outer container (2), which houses the inner package (3), and has an open end (7), and a lid (8) hinged to rotate between an open position and a closed position opening and closing the open end (7) respectively;

the package (1) being characterized in that the grip tab (25) has a first closed configuration, in which the grip tab (25) is folded 180° onto an outer surface of the sealing panel (6), so as not to project from the lid (8) when the lid (8) is in the closed position closing the open end (7) and is maintained in the closed configuration by the lid (8) in the closed position closing the open end (7); and the grip tab (25) has a second, subsequent open configuration in which the grip tab (25) is not coplanar with the sealing panel (6) so as to be grippable.

11. A packing method for producing a rigid package; the packing method comprising the steps of:

forming an extraction opening (5) in a sheet (35) of packing material;

folding the sheet (35) of packing material about a group (4) of articles to form an inner package (3) that encloses the group (4) of articles and has the extraction opening (5);

applying a reclosable sealing panel (6), which closes the extraction opening (5) of the inner package (3), and has an inner surface (21) gummed with non-dry, re-stick adhesive, and a grip tab (25) with no re-stick adhesive; and folding a blank (51) about the inner package (3) to form a rigid outer container (2), which houses the inner package (3), and has an open end (7), and a lid (8) hinged to rotate between an open position and a closed position opening and closing the open end (7) respectively;

the packing method being characterized by comprising the further steps of:

before the parts (12', 14') of the blank (51) forming the lid (8) are completely folded, folding the grip tab (25) 180° with respect to the rest of the sealing panel (6) into a first closed configuration, in which the grip tab (25) is folded 180° onto an outer surface of the sealing panel (6), so as not to project from the lid (8) when the lid (8) is in the closed position closing the open end (7); and folding the parts (12', 14') of the blank (51) forming the lid (8) over the grip tab (25) in the closed configuration, so the lid (8) in the closed position closing the open end (7) keeps the grip tab (25) in the closed configuration.

12. A packing method as claimed in claim 11, and comprising the further steps of:

keeping the grip tab (25) in the closed configuration by means of a thin first folding device (64) which presses on the grip tab (25);

folding a first part (12') of the blank (51) forming the lid (8) over the grip tab (25) and the thin first folding device by means of a second folding device (65); and withdrawing the thin first folding device (64) from the first part (12') of the blank (51) before completely folding a second part (14') of the blank (51) forming the lid (8).

* * * * *